United States Patent [19]

Beausoleil

[11] Patent Number: 4,584,574

[45] Date of Patent: Apr. 22, 1986

[54] INFORMATION DISPLAY AND EDITING SYSTEM

[75] Inventor: William F. Beausoleil, Hopewell Junction, N.Y.

[73] Assignee: International Business Machines Corporation, Armonk, N.Y.

[21] Appl. No.: 532,112

[22] Filed: Sep. 14, 1983

[51] Int. Cl.[4] ..... G09G 1/00

[52] U.S. Cl. ..... 340/744; 340/723; 340/739; 340/741

[58] Field of Search ..... 340/748, 750, 728, 798, 340/799, 739, 741, 731, 744, 797, 735

[56] References Cited

U.S. PATENT DOCUMENTS

| | | | |
|---|---|---|---|
| 3,248,725 | 4/1966 | Low et al. . | |
| 3,396,377 | 8/1968 | Strout . | |
| 3,500,470 | 3/1970 | Barker et al. . | |
| 3,553,676 | 1/1971 | Raciti | 340/744 |
| 3,597,757 | 8/1971 | LaSapinere et al. . | |
| 3,728,710 | 4/1973 | Berg . | |
| 3,781,816 | 12/1973 | Coleman et al. | 340/797 |
| 4,011,556 | 3/1977 | Tochitani et al. . | |
| 4,157,537 | 6/1979 | Check et al. | 340/741 |
| 4,418,345 | 11/1983 | Demke et al. | 340/731 |
| 4,419,661 | 12/1983 | Hetsugi | 340/731 |
| 4,428,065 | 1/1984 | Duvall et al. | 340/731 |
| 4,455,554 | 6/1984 | Demke | 340/731 |

OTHER PUBLICATIONS

Bantz et al., IBM TDB, vol. 24, No. 2, 7/81, pp. 1072–1074.

*Primary Examiner*—Gerald L. Brigance
*Attorney, Agent, or Firm*—James A. Kunkle

[57] ABSTRACT

A method and system is disclosed for displaying and editing information without flicker. Vector branch commands as well as the vectors comprising the information to be displayed are both divided into two groups. The first groups are those branch commands and vectors required to display the information requested in a recognizable form. The second groups are those branch commands and vectors required to completely display the information requested. Editing operations are performed on the recognizable form of the information to eliminate flicker. A REFRESH END COMMAND or a REFRESH END INCREMENT X COMMAND can also be used to delineate the two groups of branch commands. The REFRESH END INCREMENT X COMMAND also allows the user to add details to the display over and above those normally provided for editing operations. Faster raster-scan display refresh operations are also made possible by writing/reading only the points necessary to recognizably display images. A Character/Image End Table can also be used with the present invention to provide a separate storage area for move instructions. In addition, the advantages of the present invention can also be realized by fully displaying/refreshing only a limited portion of the screen at a time.

8 Claims, 9 Drawing Figures

INFORMATION DISPLAY AND EDITING SYSTEM

DESCRIPTION

1. Technical Field

This invention relates to displaying and editing information on a display terminal.

2. Background Art

Display terminals are being used more extensively in applications which require the display of detailed information as well as the capability to accurately edit that information. The newspaper and publishing industry is a representative example of such an application. In the proof-reading operation, it is essential that the display truly represent a copy of the final printed page. The use of a directed-beam refreshed cathode ray tube (CRT) becomes more disadvantageous as the complexity of the information to be displayed increases. These disadvantages result from the fact that these displays begin to flicker, making it more difficult to edit or view the display, when the amount of information on the display begins to overtax the refresh rate of the CRT.

Two types of refreshed CRTs have been used in these applications: refreshed raster-scan displays as well as refreshed directed-beam displays. The raster-scan type CRT is a matrix addressable display which translates binary input values into output intensity levels for every displayable point on the display screen. Each point on the screen is scanned and illuminated to the appropriate intensity level during every refresh cycle. The raster-scan display refresh rate is limited by the speed at which the refresh buffer can be written into (i.e., the output refresh rate from the buffer is fixed and the whole screen is scanned). Directed-beam type CRTs present information on the screen in the form of vectors rather than individually addressable points. These vectors are scanned, and thus regenerated along the path between their endpoints during every refresh cycle. The refresh rate of directed-beam displays, unlike raster-scan displays, is dependent on how fast the refresh data can be read out of the vector table.

As previously mentioned, refreshed directed-beam displays suffer from flicker problems when required to display complex images due to the slower refresh rate dictated by the amount of information necessary to refresh complex images. Refreshed raster-scan displays, on the other hand, suffer from the problem of updating the refresh buffer in a timely manner as the complexity of the image to be displayed increases. As this complexity increases, the amount of data required to be written into and read out of the buffer to represent that image on the display likewise increases. Writing more data into the buffer clearly consumes more time and thus slows down the refresh operation of a raster-scan display despite the fixed output rate of the buffer (i.e., input time is substantially increased).

Direct View Storage Tubes (DVSTs), which are directed-beam/vector type CRTs that can operate in both a store and refresh mode, have also been used in detailed information display applications. DVSTs can store displayed information because the phosphor layer that produces the displayed information is also the storage medium. No refreshing is necessary when the DVST is operated in store mode. An inherent advantage of the DVST, unlike a vector refresh display CRT, is that an unlimited number of vectors can be displayed (i.e., stored) without flicker. This feature coupled with the high vector addressing capability and vector pattern generator of graphics display systems such as the IBM 3277 Graphics Attachment (see McManigal and Stevenson, Architecture of the IBM 3277 Graphics Attachment, IBM Systems Journal, Vol. 19, No. 3, pp. 331–344 (1980)) offers users the capability of displaying high quality images of complex and detailed information.

Use of a DVST, however, does not solve the flicker problem associated with editing detailed information because this editing is accomplished in refresh mode not store mode. Store mode is not practical for editing because it is slow and cumbersome due to the fact that the entire screen must be erased and re-written for each change required. A DVST, therefore, is plagued by the same flicker problems during editing of complex information as are refreshed directed-beam CRTs.

DISCLOSURE OF THE INVENTION

The present invention eliminates the flicker problem during editing operations by dividing the vector graphic list for each character font or graphic entity in the pattern generator into two parts. Part one contains only the minimal number of vectors necessary to visually communicate the recognizable size, shape, and if required, the registration vectors of the graphic entity or font to be displayed. Part two contains the remaining detailed vectors which are necessary to completely display the entity or font.

When editing operations are performed (i.e., refresh mode) only the first group of vectors necessary to recognizably display the information to be edited is selected/addressed. Due to the decreased detail and complexity of the information displayed during editing operations, no flicker is present in vector type displays. Moreover, this decreased complexity also alleviates the slowdown of refresh buffer operations in raster-scan displays. After editing is completed and store mode selected in a DVST, the second group of vectors necessary to completely display the information just edited is addressed and displayed flicker-free.

The system for displaying information of the present invention employs a processor to address the information to be displayed and a pattern generator that includes a memory for storing information to be displayed and a branch table for storing branch commands. The memory is divided into an area which stores the recognizable vector groups and an area which stores the detailed vector groups. The branch table is also divided into an area of recognizable branch commands and an area of detailed branch commands. During editing operations, the processor selects the addressed recognizable branch commands which in turn command the display of the associated recognizable vector group. After editing operations are completed, the processor then selects the detailed branch commands which in turn cause the associated detailed vector group to be read out of memory and displayed.

The present invention can be used with raster-scan CRTs, directed-beam CRTs and DVSTs. Moreover, a single branch table can be used in which branch commands are arranged from the most general vector command to the most detailed vector command. A REFRESH END COMMAND is then placed after the last vector command required to recognizably display the information to be edited. A REFRESH END OR INCREMENT X COMMAND can also be used instead of a REFRESH END COMMAND. This allows the operator to effectively select the amount of detail he/she desires to be displayed for editing purposes.

The REFRESH END COMMAND and the REFRESH END OR INCREMENT X COMMAND can be written to include a move instruction as their last program statement. This move instruction causes the displaying of the next image or character to be commenced at the appropriate location on the screen. The last program statement in these COMMANDS can also be a branch instruction to a Character/Image End Table. This table stores the final move instruction associated with the character/image being displayed. Placing the move instruction(s) in this separate table instead of the memory allows the move instruction(s) to be modified without any effect on the contents of the memory.

The present invention can also be embodied by refreshing only a subset of the information displayed on the screen at a time. An additional succeeding (or preceding) increment of the information displayed is refreshed when so selected via the keyboard attached to the display. For example, only the first 100 characters would be refreshed (and edited if necessary) until the operator depresses a programmable function key to refresh the second 100 characters (a different programmable function key can also be used to refresh the preceding increment of characters instead of the succeeding increment).

The present invention has numerous advantages over prior text editing display systems. Flicker-free editing on vector displays is provided without increasing the size of the pattern generator or requiring any new vectors and buffer input operations are faster on raster-scan displays when only points necessary to display a recognizable image are input to the refresh buffer. The present invention can also be implemented so that it is transparent to the user by having the application programmer establish the optimum number of vectors required from a human factors standpoint for a recognizable display. In addition, the present invention can be implemented to allow the user to customize the amount of detail displayed during editing to suit his/her own desires.

BEST MODE FOR CARRYING OUT THE INVENTION

Figure 1:
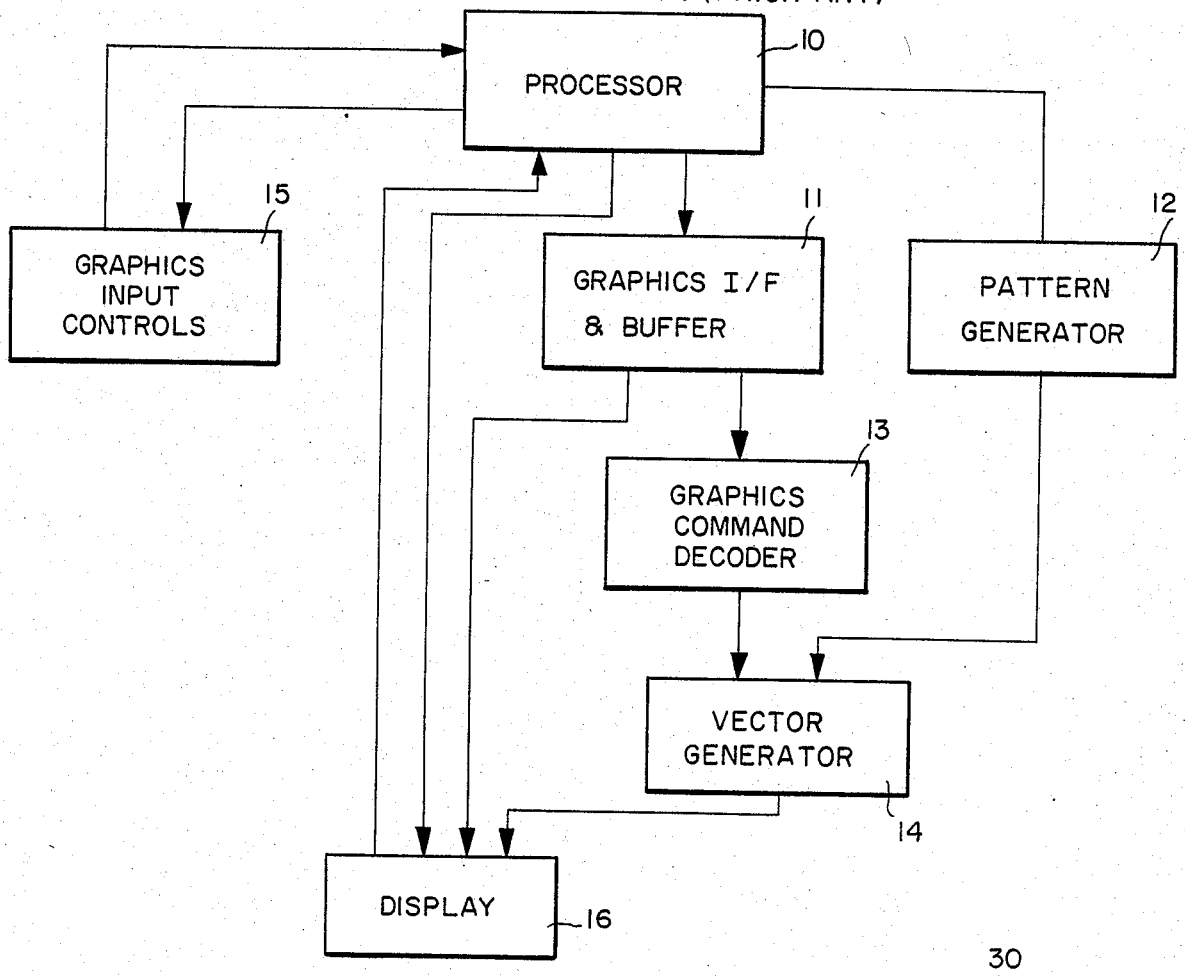
FIG. 1. (PRIOR ART)
FIG. 1 is a block diagram of the architecture of a typical graphics display system.

FIG. 1 is a typical graphics display system. This system includes a processor 10, a graphics interface and buffer 11, a pattern generator 12, a graphics command decoder 13, a vector generator 14, graphics input controls 15 and a display 16. FIG. 1 has been included for the purposes of indicating the background of the present invention and illustrating the state of the art. The basic operation of a graphics display system of the type shown in FIG. 1 is well known to those skilled in the graphics display art, therefore, it will not be discussed in detail here. For those who are not skilled in the graphics display art, the earlier referenced article of McManigal and Stevenson provides an excellent description of the operation of the graphics display system shown in FIG. 1. This publication is incorporated herein by reference.

Figure 2:
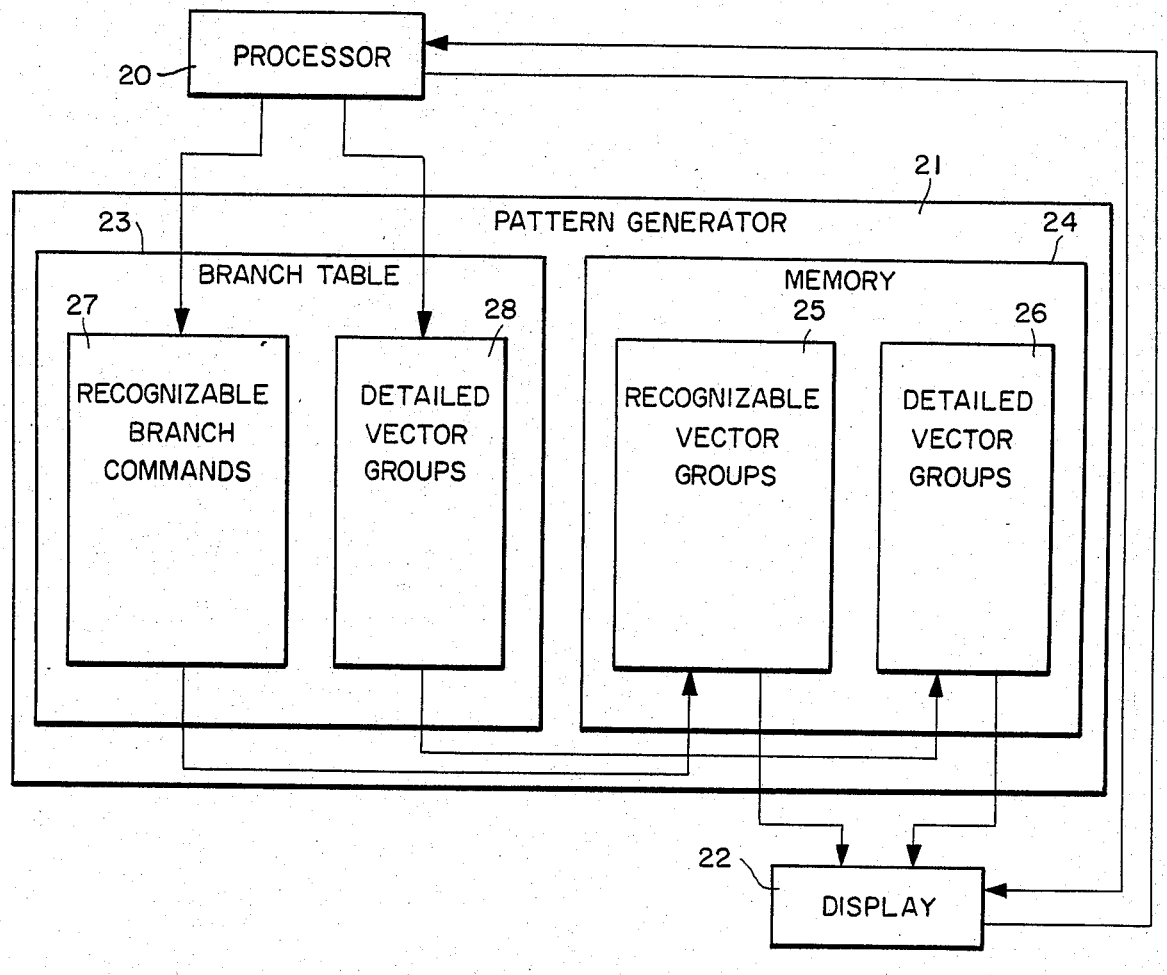
FIG. 2 is a block diagram of an embodiment of the present invention.

Referring now to FIG. 2, the graphics display system of the present invention includes a processor 20, a pattern generator 21 and a display 22. In addition to these elements, the vector graphics display system of the present invention also, of course, requires the FIG. 1 elements of graphics interface and buffer 11, graphics command decoder 13, vector generator 14 and graphics input controls 15. These elements have been omitted from FIGS. 2–4 in order to focus on the differences between the pattern generator 12 of typical systems and the pattern generator 21 of the present invention.

Figure 3:
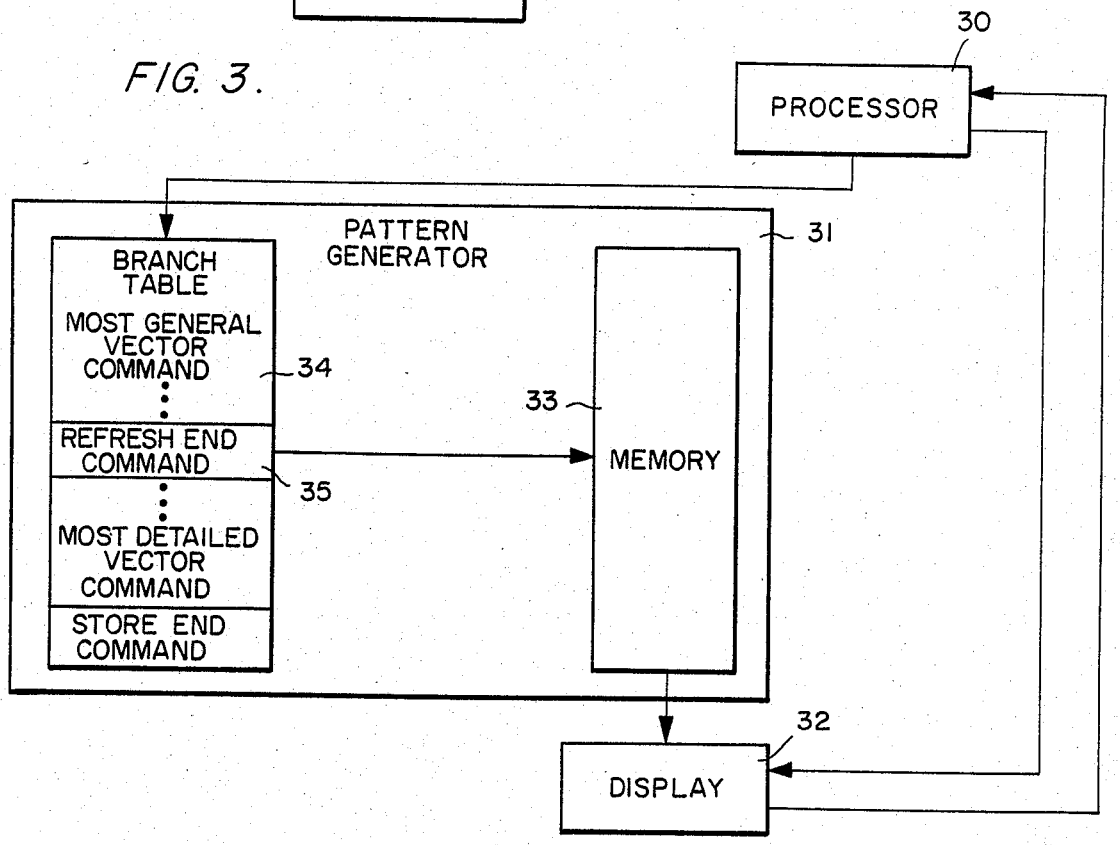
FIG. 3 is a block diagram of another embodiment of the present invention.
Figure 6:
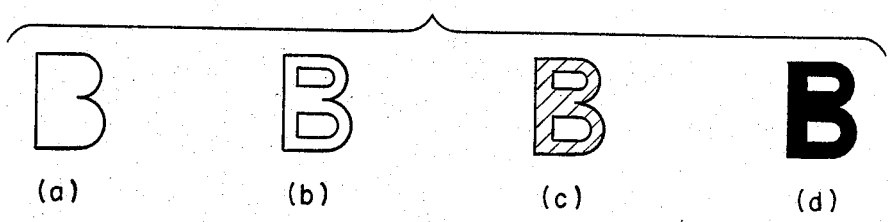
FIG. 6 is an illustration of four possible levels of detail of a displayable character.

Referring again to FIG. 2, pattern generator 21 includes a branch table 23 and a memory 24. Memory 24 has a first group of vectors 25 and a second group of vectors 26. These groups of vectors can be stored in distinctive areas of a single memory or in physically different memory modules. Vector group 25 is the group of vectors necessary to recognizably display the information addressed by processor 20 via branch table 23. Vector group 26 is the group of vectors necessary to completely display the information addressed by processor 20 via branch table 23. FIG. 6 indicates four (i.e., a–d) levels of detail for the character "B". Vector group 25 could consist of the vectors necessary to display level a, b or c while vector group 26 consists of the vectors necessary to display level d. Vector group 25 can be a subset of the vectors in vector group 26 (i.e., vector group 26 consists of the complete set of vectors associated with the information to be displayed) or the complete set of vectors associated with the information to be displayed can be divided into an independent recognizable group (placed in vector group 25) and a dependent detailed group (placed in vector group 26). This latter approach, of course, reduces the size of the memory required to store vector group 26 since this group is not required to store the complete set of vectors associated with the information to be displayed. FIG. 2 illustrates the first approach while FIG. 3 illustrates the latter approach.

Referring again to FIG. 2, branch table 23 has a first table 27 for storing branch commands associated with vector group 25 (i.e., recognizable branch commands) and a second table 28 for storing branch commands associated with vector group 26 (i.e., detailed branch commands). These tables can be separately selectable within a single memory module or they can be physically different memory modules.

Once the information to be displayed is divided into vector groups 25 and 26 and stored in memory 24 and the branch commands to both of these vector groups are stored in branch table 23, processor 20 addresses recognizable branch commands 27. This results in recognizable vector group 25 being displayed. Editing operations can now be performed on this flicker-free display of recognizable information. Once editing operations have been completed, processor 20 addresses detailed vector group 26. This results in completely displaying the information selected by processor 20.

If a raster-scan CRT is used in conjunction with the present invention instead of a directed-beam CRT, the division will be between recognizable and detailed branch commands and points associated with those commands rather than vectors. Only the points necessary for a recognizable display would be written into/-read out of the refresh buffer. Limiting the amount of data in the buffer in this fashion results in faster refresh operations due to the faster overall I/O rate caused by the faster input (i.e., less information is written into the buffer).

Figure 9:
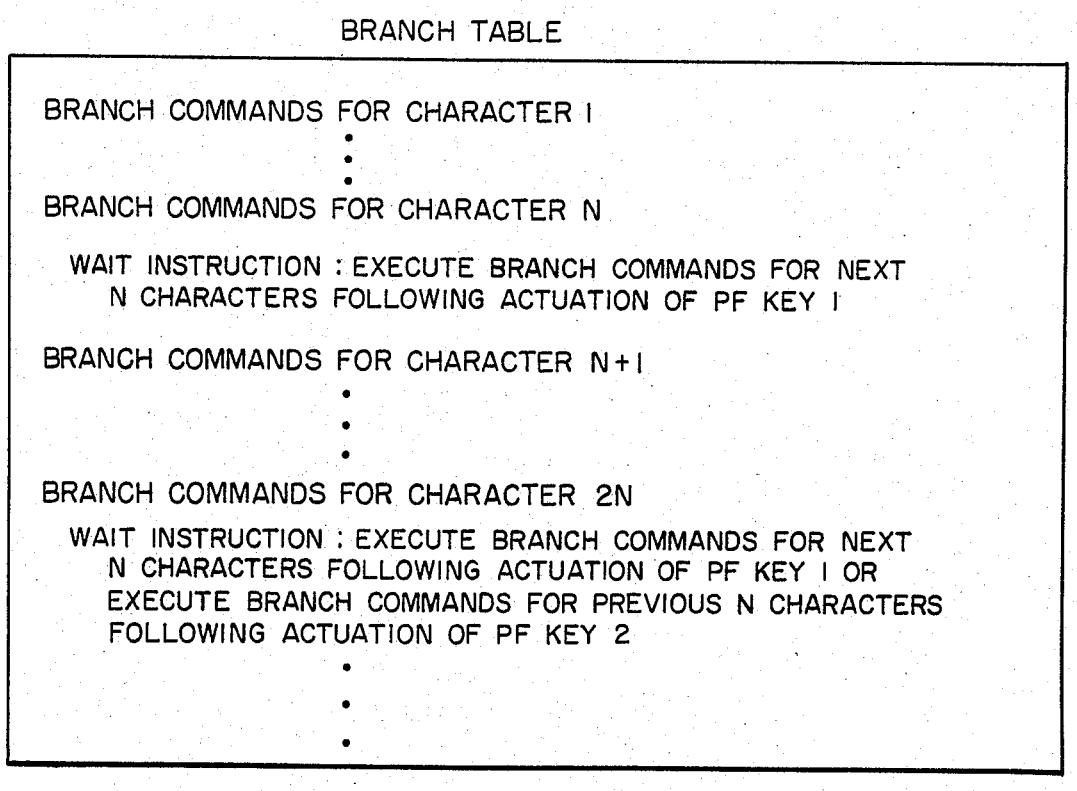
FIG. 9 is a functional illustration of still another embodiment of the present invention.

The present invention can also be embodied by refreshing only a subset of the information displayed on the screen at a time. An additional succeeding (or preceding) increment of the information displayed is refreshed when so selected via the keyboard attached to the display. For example, only the first 100 characters would be refreshed (and edited if necessary) until the operator depresses a programmable function key to refresh the second 100 characters (a different programmable function key can also be used to refresh the preceding increment of characters instead of the succeeding increment). This embodiment is illustrated in FIG. 9 wherein the first N characters to be displayed on the screen are displayed in full detail and refreshed. No more of the screen is filled in until PF (i.e., programmable function) key 1 is actuated by the operator. Upon actuation of PF Key 1 (many terminal keyboards such as the IBM 3277 have PF key options currently available to perform this function) the next set of N characters will be fully displayed while the previous set of N characters will not continue to be displayed/refreshed. Upon another activation of PF Key 1 the third set of N characters will be fully displayed and refreshed. Activation of PF Key 2 would result in the re-display/refresh of the first group of N characters. The same advantages gained via the other embodiments of the present invention are also realized here (i.e., flicker-free editing on vector/directed-beam displays and faster refresh buffer input operations on raster scan displays). This is of course the case because only a relatively small part of the display is being refreshed in the embodiment shown in FIG. 9 and, therefore, the faster the overall refresh rate. Just as accomplished with the use of a REFRESH END OR INCREMENT X COMMAND instead of a REFRESH END COMMAND described below, an operator can be permitted to set the value of N with this FIG. 9-sliding window embodiment.

Although the present invention can be used with directed-beam and raster scan CRTs, the best mode for carrying out the present invention at this time, however, is with DVSTs. Because the DVST can completely display complex information in store mode flicker-free, but is required as a practical matter to perform editing operations in a flicker prone refresh mode, the present invention allows editing operations to also be performed on a flicker-free display. This is accomplished by processor 20 placing display 22 in refresh mode and then addressing recognizable branch commands 27. This results in the display of recognizable vector group 25. Editing operations can now be performed on a flicker-free display. When editing operations have been completed, processor 20 places display 22 in store mode and then addresses detailed branch commands 28. This results in the display of detailed vector group 26. This display is also flicker-free because display 22 is in store mode.

Referring now to FIG. 3, the present invention can also be implemented using processor 30, pattern generator 31, and display 32. Pattern generator 31 includes a memory 33 and a branch table 34. Memory 33 is equivalent to memory 24 of FIG. 2 in that it stores recognizable and detailed vectors. Branch table 34 stores a continuum of vector branch commands from the most general to the most detailed. The application programmer then places a REFRESH END COMMAND 35 (which terminates execution of vector commands) after the last branch command necessary to display the information requested by processor 30 in recognizable form (i.e., REFRESH END COMMAND 35 splits branch table 34 into a group of recognizable branch commands and a group of detailed branch commands). The determination of where REFRESH END COMMAND 35 is placed is based on human factors considerations and testing which indicates how much information is necessary to enable accurate editing operations to occur without flicker (for example, see FIG. 6).

Figure 4:
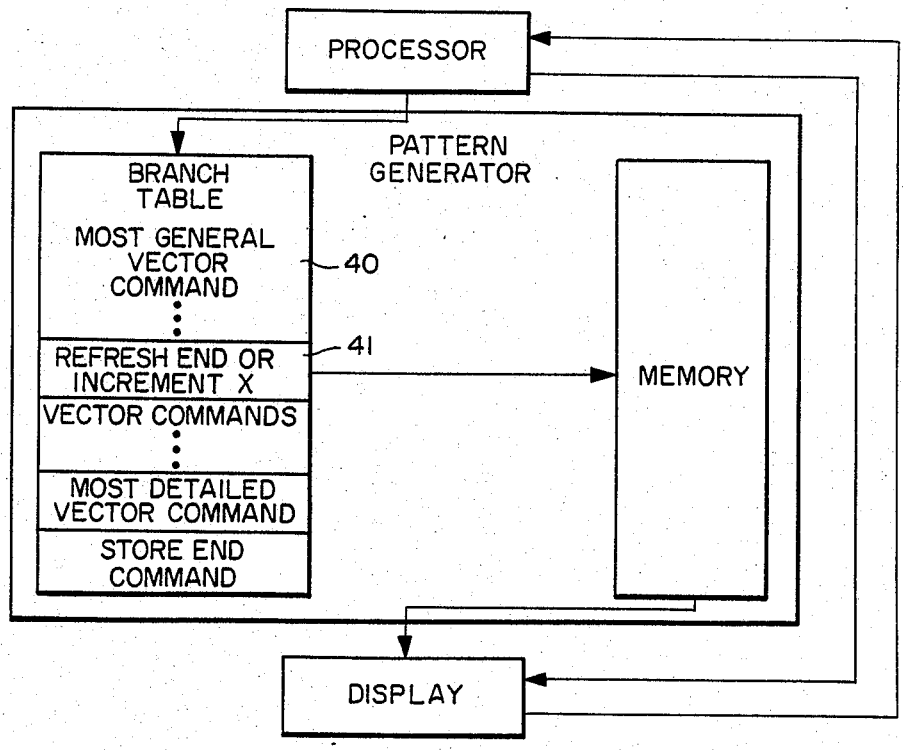
FIG. 4 is a block diagram of another embodiment of the present invention.

Referring now to FIG. 4, the present invention can also be implemented with branch table 40. Branch table 40, like branch table 34 of FIG. 3, stores a continuum of vector branch commands from the most general to the most detailed. A looping REFRESH END OR INCREMENT X COMMAND 41, however, is used instead of a REFRESH END COMMAND. This REFRESH END OR INCREMENT X COMMAND 41 can be located anywhere in branch table 40, but it is most effectively located at the same position as COMMAND 35 in FIG. 3. COMMAND 41 allows the user/operator to select the amount of information he/she desires for editing operations (i.e., COMMAND 41 allows the user to accept the level of detail provided up to encountering COMMAND 41 or to enhance his/her display by requiring X more vectors to be displayed). This allows initially sub-recognizable information to be displayed which can be incremented at an operator's discretion until a sufficient amount of detail is displayed to allow that operator to accurately edit the display. REFRESH END OR INCREMENT X COMMAND 41 can take many instructional forms but it essentially comprises a simple instructional loop such as that illustrated in FIG. 5.

Figure 5:
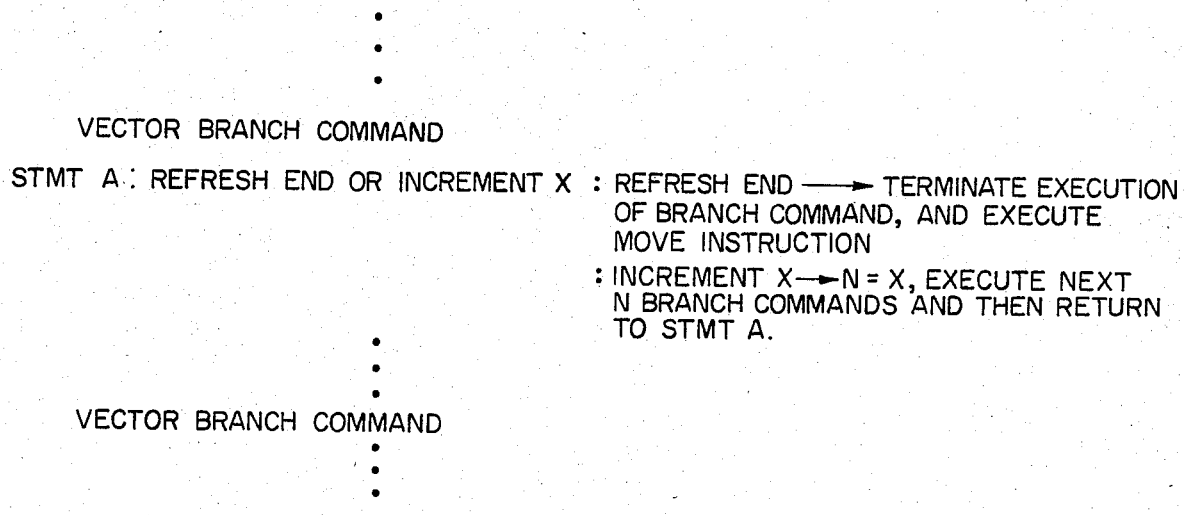
FIG. 5 is a functional illustration of a REFRESH END OF INCREMENT X COMMAND.
Figure 7:
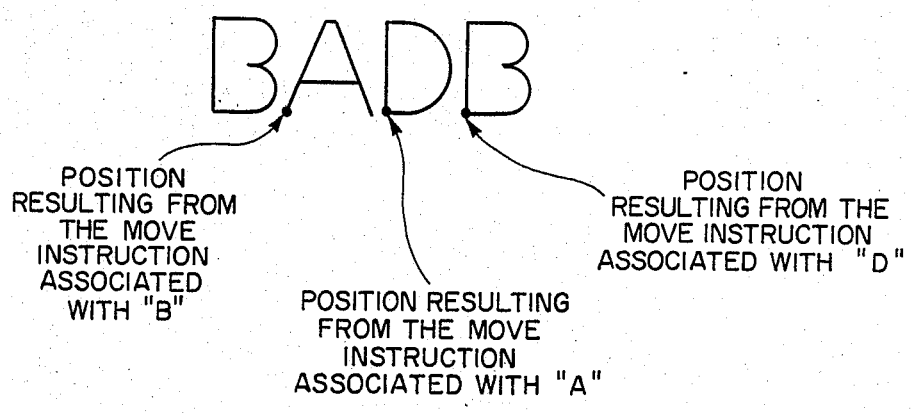
FIG. 7 is an illustration of the initialization positioning associated with move instructions.
Figure 8:
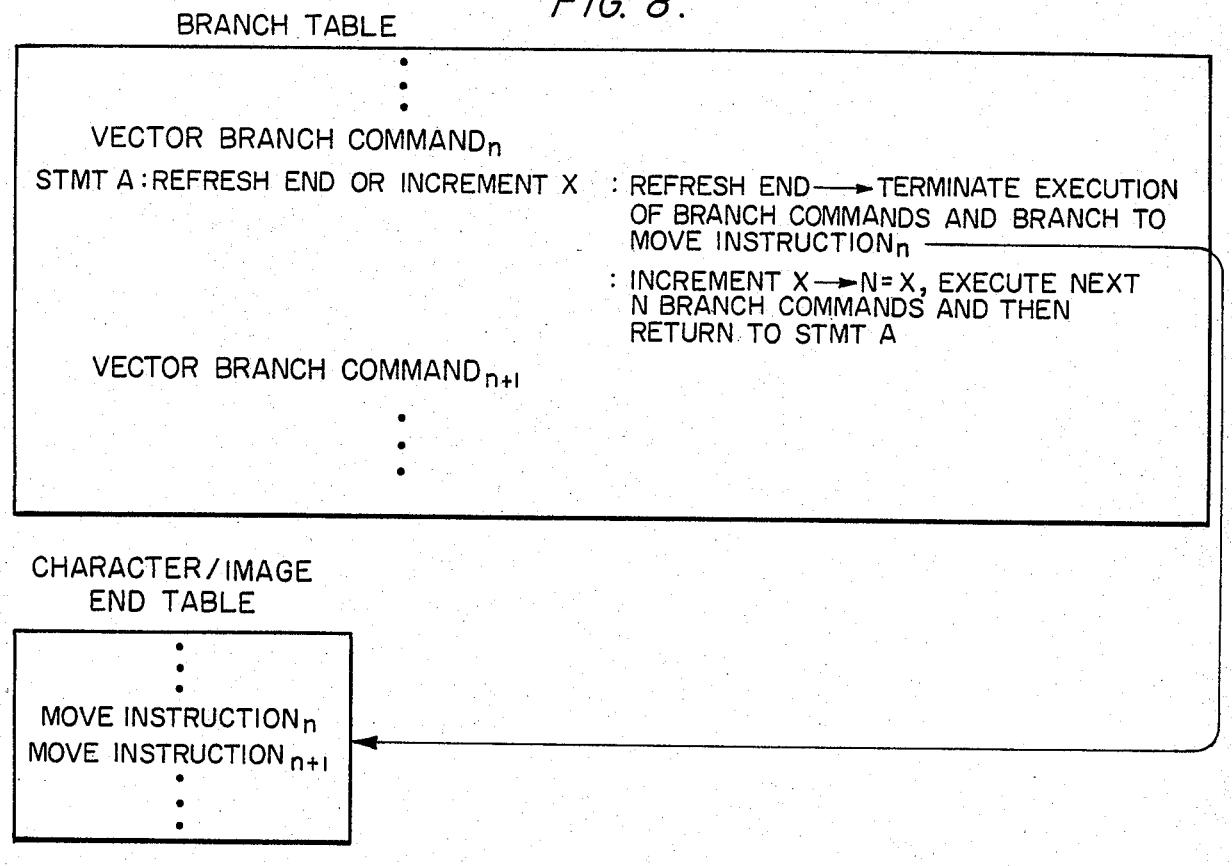
FIG. 8 is a block diagram of another embodiment of the present invention.

The REFRESH END COMMAND and the REFRESH END OR INCREMENT X COMMAND can be written to include a move instruction as their last effective program statement (see FIG. 5). This move instruction causes the displaying of the next image or character to start at the appropriate location on the screen (see FIG. 7). The last program statement in these COMMANDS can also be a branch instruction to a Character/Image End Table. This embodiment is illustrated in FIG. 8. Once the execution of vector branch commands is terminated, the last program statement executed in the Branch Table is a branch to the move instruction associated with the last vector branch command executed. This results in a branch and execution of the appropriate move instruction stored in the Character/Image End Table. The end result is of course the same as when the move instructions themselves were stored within the Branch Table (see FIG. 7—i.e., the display is initialized to the appropriate position to allow for the correct display of the next character/image). There is an advantage in placing the move instructions in a separate memory (i.e. the Character/Image End Table), however, in that the move instructions can be modified without disturbing the contents of the Branch Table.

While the present invention has been particularly described with reference to the preferred embodiment thereof, it will be understood by those skilled in the art that various changes in form and detail may be made therein, without departing from the spirit and scope of the invention as illustrated in the appended claims.

I claim:

1. A method for displaying and editing information on a storage tube comprising the steps of:

dividing the information to be displayed into a first group of vectors necessary to display a recognizable version of the information to be displayed and a second group of vectors necessary to display a detailed version of the information to be displayed;

storing said first group of vectors and said second group of vectors in a memory means;

storing a first group of branch commands to said first group of vectors and a second group of branch commands to said second group of vectors in a branch table means;

placing said storage tube in refresh mode;

addressing said first group of branch commands;

displaying said first group of vectors while said storage tube is in refresh mode;

editing said first group of vectors;

placing said storage tube in store mode;

addressing said second group of branch commands, and displaying said second group of vectors while said storage tube is in store mode.

2. A system including a display for displaying information comprising:

a processor means for addressing information to be displayed, and a pattern generator coupled to said processor means for generating a recognizable version and a detailed version of the information addressed by said processor means, said pattern generator including:

a memory means for storing information to be displayed in the form of vectors, said memory further comprising:

a first group of vectors necessary to recognizably display the information addressed by said processor means and a second group of vectors necessary to completely display the information addressed by said processor means; and a branch table means coupled to said memory means for storing branch commands, said branch table means further comprising:

a first group of branch commands to said first group of vectors;

a second group of branch commands to said second group of vectors; and a "refresh end" command which terminates execution of branch commands located between said first group of branch commands and said group of branch commands for splitting said branch table onto a group of recognizable branch commands and a group of detailed branch commands;

whereby information can be recognizably displayed without flicker for editing purposes and be completely displayed once editing has been accomplished.

3. A system for displaying information on a storage tube comprising:

a processor means for addressing information to be displayed and for placing said storage tube in store mode and refresh mode, and a pattern generator coupled to said processor means for generating a recognizable version of the information addressed by said processor means when said storage tube is operated in refresh mode and a detailed version when said storage tube is operated in store mode, said pattern generator including:

a memory means for storing information to be displayed in the form of vectors, said memory means further comprising:

a first group of vectors necessary to recognizably display the information addressed by said processor means and a second group of vectors necessary to completely display the information addressed by said processor means; and a branch table means coupled to said memory means for storing branch commands, said branch table means further comprising:

a first group of branch commands to said first group of vectors; and a second group of branch commands to said second group of vectors; and a "refresh end" command which terminates execution of branch commands located between said first group of branch commands and said second group of branch commands for splitting said branch table into a group of recognizable branch commands and a group of detailed branch commands;

whereby information can be recognizably displayed without flicker for editing purposes while said storage tube is operated in refresh mode and be completely displayed when said storage tube is operated in store mode.

4. A system for displaying information comprising:

a processor means for addressing information to be displayed, and a pattern generator coupled to said processor means for generating a sub-recognizable version through a detailed version of the information addressed by said processor means, said pattern generator including:

a memory means for storing information to be displayed in the form of vectors, said memory means further comprising:

a first group of vectors necessary to sub-recognizably display the information addressed by said processor means and a second group of vectors necessary to completely display the information addressed by said processor means; and a branch table means coupled to said memory means for storing branch commands, said branch table means further comprising:

a first group of branch commands to said first group of vectors;

a second group of branch commands to said second group of vectors; and a "refresh end or increment X" command which permits operator selection of the number of vectors in said first group of vectors;

said "refresh end of increment X" command being located between said first group of branch commands and said second group of branch commands;

whereby information can be initially displayed in a sub-recognizable form without flicker and incremented at an individual operator's discretion until a sufficient amount of detail is displayed to allow that operator to edit the display.

5. A system for displaying information on a storage tube comprising:

a processor means for addressing information to be displayed and for placing said storage tube in store mode and refresh mode, and a pattern generator coupled to said processor means for generating a sub-recognizable version through a recognizable version of the information addressed by said processor means when said storage tube in operated in refresh mode and a detailed version when said storage tube is operated in store mode, said pattern generator including:

a memory for storing information to be displayed in the form of vectors, said memory means further comprising:

a first group of vectors necessary to sub-recognizably display the information addressed by said processor means and a second group of vectors necessary to completely display the information addressed by said processor means; and a branch table means coupled to said memory means for storing branch commands, said branch table means further comprising:

a first group of branch commands to said first group of vectors;

a second group of branch commands to said second group of vectors; and a "refresh end or increment X" command which permits operator selection of the number of vectors in said first group of vectors;

said "refresh end of increment X" command being located between said first group of branch commands and said second group of branch commands;

whereby information can be initially displayed in a sub-recognizable form without flicker and incremented at an individual operator's discretion until the information displayed is recognizable to that operator to edit the display while said storage tube is operated in refresh mode.

6. A method for displaying and editing information comprising the steps of:

dividing the information to be displayed into a first group of vectors necessary to display a sub-recognizable version of the information to be displayed and a second group of vectors necessary to display a detailed version of the information to be displayed;

storing said first group of vectors and said second group of vectors in a memory means;

storing a first group of branch commands to said first group of vectors and a second group of branch commands to said second group of vectors in a branch table means;

addressing said first group of branch commands;

displaying said first group of vectors;

addressing at least one additional branch command within said second group of branch commands;

displaying at least one additional vector within said second group of vectors;

editing said first group of vectors plus said at least one additional vector within said second group of vectors;

addressing the remaining vectors within said second group of vectors; and displaying said remaining vectors within said second group of vectors.

7. A method for displaying and editing information on a storage tube comprising the steps of:

dividing the information to be displayed into a first group of vectors necessary to display a sub-recognizable version of the information to be displayed and a second group of vectors necessary to display a detailed version of the information to be displayed;

storing said first group of vectors and said second group of vectors in a memory means;

storing a first group of branch commands to said first group of vectors and a second group of branch commands to said second group of vectors in a branch table means;

placing said storage tube in refresh mode;

addressing said first group of branch commands;

displaying said first group of vectors;

addressing at least one additional branch command within said second group of branch commands;

displaying at least one additional vector within said second group of vectors;

editing said first group of vectors plus said at least one additional vector within said second group of vectors;

placing said storage tube in a store mode;

addressing the remaining vectors within said second group of vectors; and displaying said remaining vectors within said second group of vectors.

8. A system for displaying information comprising:

a processor means for addressing information to be displayed;

a pattern generator coupled to said processor means for generating a recognizable version and a detailed version of the information addressed by said processor means, said pattern generator including:

a memory means for storing information to be displayed in the form of vectors, said memory means further comprising:

a first group of vectors necessary to recognizably display the information addressed by said processor means and a second group of vectors necessary to completely display the information addressed by said process means; and a branch table means coupled to said memory means for storing branch commands, said branch table means further comprising:

a first table for storing branch commands to said first group of vectors;

a second table separately selectable from said first table for storing branch commands to said second group of vectors;

move instructions which initiate the display of the next succeeding image or character;

a character/image end table addressed by the last branch command in said branch table and coupled to said branch table means for storing said move instructions associated with said branch commands;

whereby information can be recognizable displayed without flicker for editing purposes and be completely displayed once editing has been accomplished.

* * * * *

UNITED STATES PATENT AND TRADEMARK OFFICE

CERTIFICATE OF CORRECTION

PATENT NO. : 4,584,574

DATED : April 22, 1986

INVENTOR(S) : W. F. Beausoleil

It is certified that error appears in the above-identified patent and that said Letters Patent is hereby corrected as shown below:

In the Claims:

| | |
|---|---|
| Claim 2, line 63 | Delete "onto" and substitute therefor --into--. |
| Claim 5, line 17 | Delete "in", first occurrence, and substitute therefor -- is--. |
| Claim 5, line 20 | After " memory " insert --means--. |
| Claim 8, line 64 | Delete "recognizable" and insert therefor --recognizably--. |

Signed and Sealed this

Thirtieth Day of December, 1986

*Attest:*

DONALD J. QUIGG

*Attesting Officer*

*Commissioner of Patents and Trademarks*